US011233378B2

(12) United States Patent
Healy et al.

(10) Patent No.: US 11,233,378 B2
(45) Date of Patent: Jan. 25, 2022

(54) SPARK PLUG COUPLER

(71) Applicant: Walbro LLC, Tucson, AZ (US)

(72) Inventors: Cyrus M. Healy, Ubly, MI (US); Eric L. King, Caro, MI (US)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 16/766,434

(22) PCT Filed: Nov. 30, 2018

(86) PCT No.: PCT/US2018/063250
§ 371 (c)(1),
(2) Date: May 22, 2020

(87) PCT Pub. No.: WO2019/108896
PCT Pub. Date: Jun. 6, 2019

(65) Prior Publication Data

US 2021/0075197 A1 Mar. 11, 2021

Related U.S. Application Data

(60) Provisional application No. 62/593,667, filed on Dec. 1, 2017.

(51) Int. Cl.
*H01T 13/04* (2006.01)
*H01R 4/14* (2006.01)
(Continued)

(52) U.S. Cl.
CPC ..... *H01T 13/04* (2013.01); *H01R 4/14* (2013.01); *H01R 24/20* (2013.01); *H01T 13/20* (2013.01)

(58) Field of Classification Search
CPC ..... H01T 13/20; H01T 13/04; H01T 13/05; H01T 13/34; H01T 13/56; H01R 24/20; H01R 4/14; H01R 13/2421
(Continued)

(56) References Cited

U.S. PATENT DOCUMENTS 4,715,337 A * 12/1987 Bohl ..... F02P 13/00 123/169 PA
4,997,380 A * 3/1991 Etienne ..... H01T 13/04 439/127

(Continued)

FOREIGN PATENT DOCUMENTS

JP H1089221 A 4/1998
JP 2008095631 A 4/2008
JP 2012193670 A 10/2012

OTHER PUBLICATIONS

Written Opinion & International Search Report for PCT/US2018/063250 dated Mar. 26, 2019, 11 pages.

*Primary Examiner* — Renee S Luebke
*Assistant Examiner* — Paul D Baillargeon
(74) *Attorney, Agent, or Firm* — Reising Ethington P.C.; Matthew J. Schmidt

(57) ABSTRACT

In at least some implementations, a coupler for a spark plug includes a body formed from an electrically conductive material and including a first connecting portion defining a first cavity, and a second connecting portion defining a second cavity spaced from the first cavity, and the body includes an intermediate portion physically and electrically coupling the first connection portion and the second connecting portion. In at least some implementations, the first connecting portion is formed from a wire coiled to define the first cavity within the coil. In at least some implementations, the second connecting portion is formed from a wire coiled to define the second cavity within the coil.

21 Claims, 4 Drawing Sheets

(51) Int. Cl.
*H01R 24/20* (2011.01)
*H01T 13/20* (2006.01)

(58) Field of Classification Search
USPC ..... 174/152; 439/125, 126, 127, 128
See application file for complete search history.

(56) References Cited

U.S. PATENT DOCUMENTS

| | | | | |
|---|---|---|---|---|
| 7,392,799 | B2 * | 7/2008 | Fujiyama | H01F 5/02 123/634 |
| 7,681,563 | B2 * | 3/2010 | Idogawa | H01F 38/12 123/634 |
| 8,225,775 | B1 * | 7/2012 | Idogawa | H01F 27/02 123/634 |
| 9,117,585 | B2 * | 8/2015 | Skinner | F02P 3/04 |
| 10,084,291 | B2 * | 9/2018 | Carlson | H01T 15/00 |
| 2012/0186568 | A1 | 7/2012 | Steinberger | |
| 2014/0328002 | A1 | 11/2014 | Silva et al. | |

* cited by examiner

SPARK PLUG COUPLER

REFERENCE TO RELATED APPLICATIONS

This application claims the benefit of U.S. Provisional Application Ser. No. 62/593,667 filed on Dec. 1, 2017 the entire contents of which are incorporated herein by reference in its entirety.

TECHNICAL FIELD

The present disclosure relates to a coupler for connecting a spark plug cable to a spark plug.

BACKGROUND

Gasoline powered spark ignition internal combustion engines, and particularly light duty and small engines, are used on a large variety of products including handheld, lawn and garden, marine, snowmobile and other home and commercial products. These engines are typically two-cycle or four-cycle engines with one or more cylinders and have a spark plug for each cylinder that in use initiates combustion of a fuel-and-air mixture in the cylinder. The spark plug is typically threaded or otherwise secured in a bore in a metal cylinder head or cylinder of the engine which provides a ground for a metal shell or body of the spark plug. An electrically conductive center electrode typically with a copper core extends through the metal body with one end spaced by a gap from the ground electrode and is received in a typically ceramic insulator which projects from the other end of the body and carries an electrically conductive terminal connected to the center electrode.

In use, a high potential voltage current is supplied to the center electrode to produce an arc or spark in the gap. Typically, an electrically insulating boot is received over the terminal and an exposed portion of the insulator of the spark plug and terminates short of or adjacent the upper end of the spark plug shell or body.

SUMMARY

In at least some implementations, a coupler for a spark plug includes a body formed from an electrically conductive material and including a first connecting portion defining a first cavity, and a second connecting portion defining a second cavity spaced from the first cavity, and the body includes an intermediate portion physically and electrically coupling the first connection portion and the second connecting portion. In at least some implementations, the first connecting portion is formed from a wire coiled to define the first cavity within the coil. In at least some implementations, the second connecting portion is formed from a wire coiled to define the second cavity within the coil.

In at least some implementations, the first connecting portion is formed from a wire coiled to define the first cavity within the coil, and the second connecting portion is formed from a wire coiled to define the second cavity within the coil, and wherein the same wire defines both the first and second connecting portions. In at least some implementations, the intermediate portion is also defined by the wire that defines both the first and second connecting portions.

In at least some implementations, an end of the wire is adjacent to or defines part of the coil that defines first cavity and the end of the wire is defined in a tang that extends outwardly relative to the coil that defines the first cavity. The tang may extend radially outwardly beyond the coil that defines the first cavity, and may provide a portion of the wire to which a force can be applied tending to unwind or enlarge the internal size of the coil. The tang may be defined in a frangible portion of the wire that is defined by or includes a weakened portion of the wire. The weakened portion may be defined by or include a notch or slot which provides a thinner or weaker portion of the wire at which the wire will break when sufficient force is applied. The weakened portion may be provided in a surface of the wire that faces inwardly toward a centerline of the coil that defines the first cavity. And the weakened portion of the wire may be located in a portion of the wire that is not radially outward of the coil that defines the first cavity or that extends radially outwardly of the coil that defines the first cavity by 1 mm or less.

In at least some implementations, a second end of the wire is adjacent to or defines part of the coil that defines second cavity. The second end of the wire is not, in at least some implementations, located radially outwardly of the coil that defines the second cavity or the second end of the wire is located radially outwardly of the coil that defines the second cavity by 1 mm or less.

In at least some implementations, an assembly includes a coupler formed from an electrically conductive material and including a first connecting portion defining a first cavity, and the body includes a second connecting portion defining a second cavity spaced from the first cavity, and the body including an intermediate portion physically and electrically coupling the first connection portion and the second connecting portion, a power supply cable having an electrically conductive core wherein the cable is partially received within the first cavity with the core engaged with the first connecting portion, and a spark plug. The spark plug has a terminal wherein the terminal is received at least partially within and engaged by the second connecting portion.

In at least some implementations, the first connecting portion is formed from a wire having a first coil that defines the first cavity, and the second connecting portion is formed from a second coil of wire that defines the second cavity, and wherein the same wire defines both the first and second coils. In at least some implementations, one or both of the first coil and second coil are defined by loops of wire that may move relative to each other so that the coupler is flexible. In at least some implementations, the intermediate portion is also defined by the wire that defines both the first and second connecting portions.

In at least some implementations, an end of the wire is adjacent to or defines part of the coil that defines first cavity and the end of the wire is defined in a tang that extends outwardly relative to the coil that defines the first cavity. The tang may extend radially outwardly beyond the coil that defines the first cavity. The tang may be defined in a frangible portion of the wire that is defined by or includes a weakened portion of the wire, and wherein the weakened portion is defined by or includes a notch or slot. The weakened portion may be provided in a surface of the wire that faces inwardly toward a centerline of the coil that defines the first cavity. And the weakened portion of the wire may be located in a portion of the wire that is not radially outward of the coil that defines the first cavity or that extends radially outwardly of the coil that defines the first cavity by 1 mm or less.

In at least some implementations, a second end of the wire is adjacent to or defines part of the coil that defines second cavity and the second end of the wire is not located radially outwardly of the coil that defines the second cavity or the second end of the wire is located radially outwardly of the coil that defines the second cavity by 1 mm or less.

BRIEF DESCRIPTION OF THE DRAWINGS

The following detailed description of certain embodiments and best mode will be set forth with reference to the accompanying drawings, in which.

DETAILED DESCRIPTION

Figure 1:
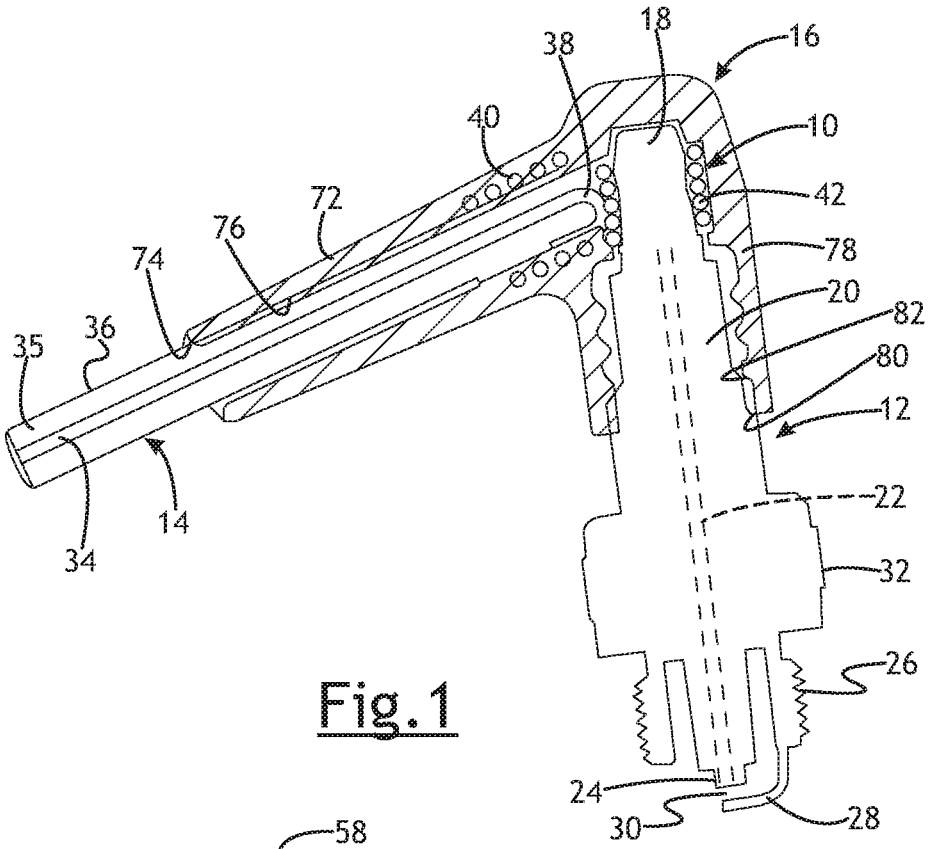
FIG. 1 is cross-section of a spark plug, boot and a portion of a power cable, with a coupler connected to the cable and spark plug.

Referring in more detail to the drawings, FIG. 1 illustrates a coupler 10 physically and electrically coupled to both a spark plug 12 and a power cable 14. An electrical charge is transferred from the cable 14, through the coupler 10 and to the spark plug 12 to generate a spark and ignite a combustible mixture within an internal combustion engine. An insulative boot 16 may be received over the connected ends of the spark plug 12 and cable 14, as well as the coupler 10.

The spark plug 12 includes an electrically conductive terminal 18 to which the coupler 10 is connected, a body 20 often including at least some portions formed from a ceramic material, a center electrode 22 received within the body and extending from the terminal 18 to a free end 24, a threaded portion 26 exposed from the boot 16, a ground electrode 28 spaced from the free end of the center electrode 22 by a gap 30 and a tool receiving portion 32. The tool receiving portion 32 may be disposed between the ceramic body 20 and the threaded portion 26 and provides a surface about which a tool is received to rotate the spark plug 12 so that the threaded portion is advanced into a threaded bore on an internal combustion engine (not shown).

The cable 14 may be any suitable spark plug cable, and may have an electrically conductive core 34 received within an insulator 35 that surrounds the core 34 and has an interior against the core 34 and an exterior surface 36. At the end of the cable 14 adjacent to the spark plug 12, an end portion 38 of the core 34 may be exposed from the insulator 35 (e.g. the insulator may be stripped from a portion of the cable to expose an end of the core). In the example shown, the end portion 38 of the core 34 extends from an end of the insulator 35 and is folded down against the exterior surface 36 of the insulator 35. The end portion 38 should be of a length such that it does not extend outwardly from the boot 16 when installed on the cable 14 and spark plug 12, such as is shown in FIG. 1. The cable 14 may be any suitable type of spark plug cable, including any desired core 34 and insulator 35, and may further include one or more materials along with the core 34 and insulator 35 to, for example, reduce electromagnetic or radio frequency emissions or interference (e.g. an inductive element or other material).

Figure 2:
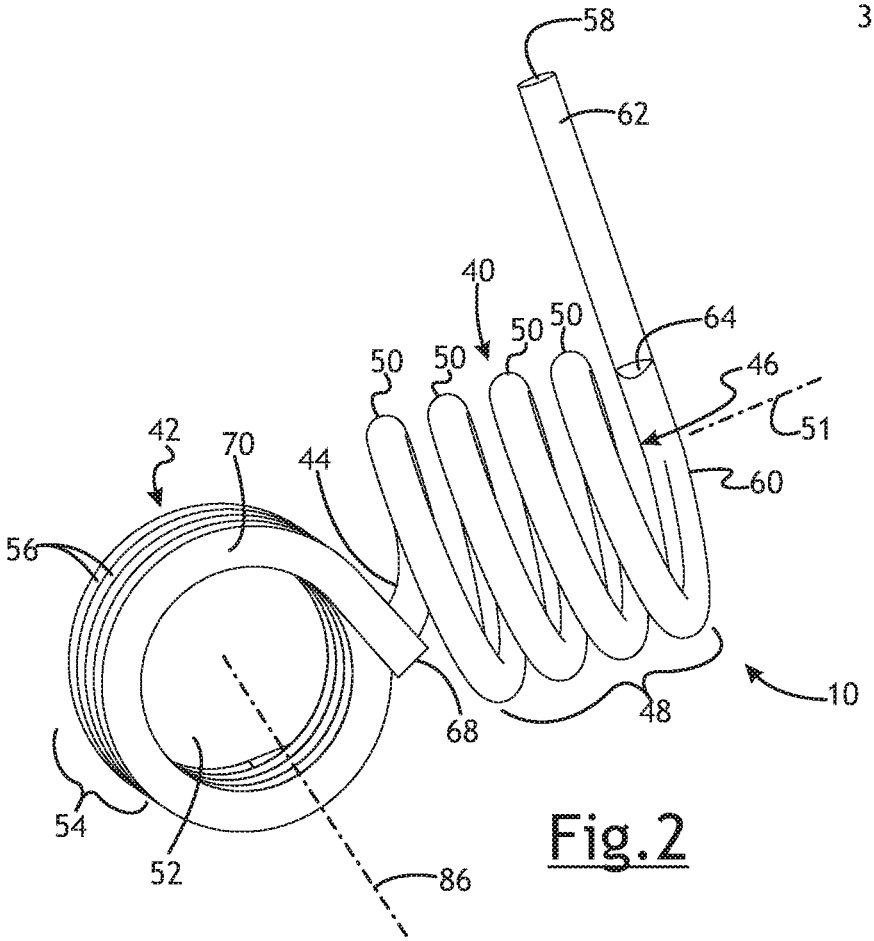
FIG. 2 is a perspective view of the coupler.
Figure 3:
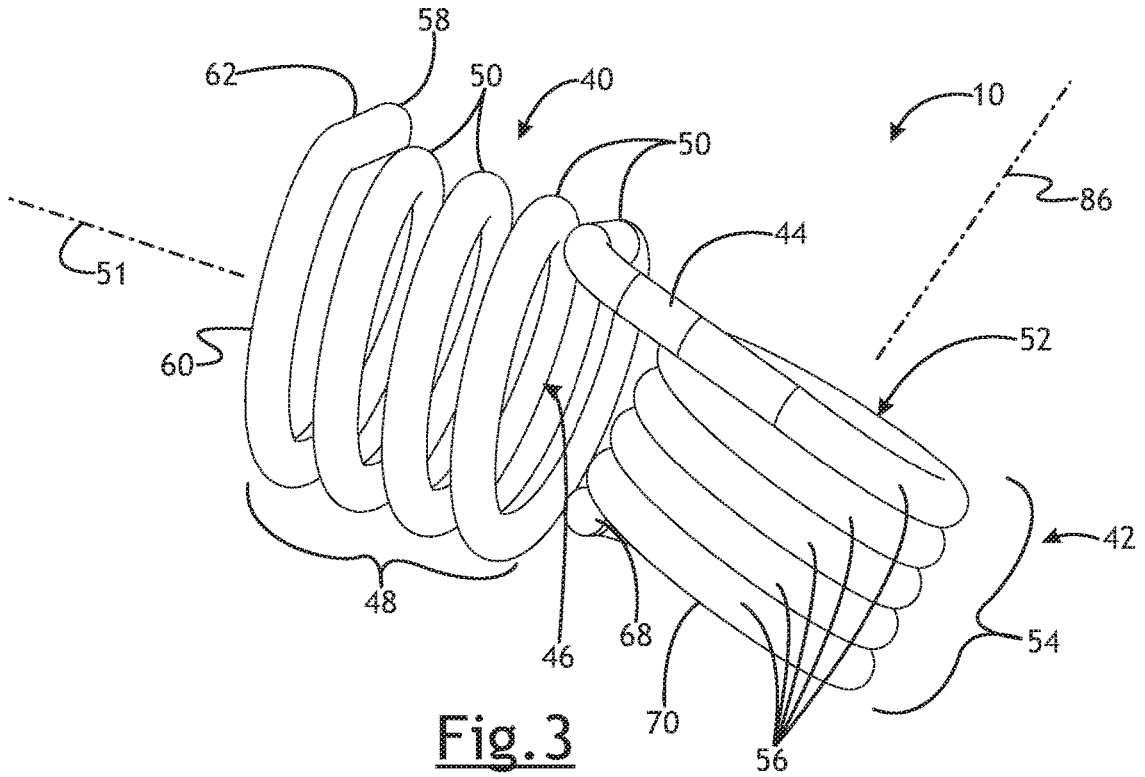
FIG. 3 is another perspective view of the coupler.

As shown, for example, in FIGS. 2 and 3, the coupler 10 has a first connecting portion 40, a second connecting portion 42 and an intermediate portion 44 extending between the two connecting portions 40, 42. The coupler 10 may be formed from a single piece of conductive material, such as, but not limited to various metals, graphite and other conductive materials. Of course, the coupler 10 could be formed in multiple pieces that are electrically connected to permit communication of electricity from the cable 14 to the spark plug 12 through the coupler 10. The coupler, in at least some implementations, should be designed for use with up to 50 kV or whatever voltage and current conditions are needed for the spark plug in a particular application. In at least some implementations, the coupler is formed from hard drawn steel wire, and may be of MB grade.

The first connecting portion 40 includes a first cavity 46 in which the end of the cable 14 is received, and the first connecting portion 40 is hereafter called a cable connecting portion 40. To electrically couple the coupler 10 to the core 34, the cavity 46 may be sized for an interference fit with the cable end including the end 38 of the core 34 folded against the exterior surface 36, so that the core 34 is firmly engaged by the coupler 10. In addition to or instead, the core 34 could be soldered to the coupler 10 or another conductive member could be provided to electrically connect the coupler 10 and core 34. The cable connecting portion 40 may be flexible to facilitate pressing the cable 14 into the cavity.

In at least some implementations, the cable connecting portion 40 is formed by a first coil 48 of wire including a plurality of wire loops 50 arranged in a helical and cylindrical formation of a desired size. The individual wraps or loops 50 of the wire may move relative to other loops which makes the cable connecting portion 40 somewhat flexible, and which also provides a plurality of potential contact points between the coupler 10 and the core 34. Further, the cable connecting coil 48 may have any desired length (axial dimension relative to an axis or centerline 51 of the cavity 46) and the loops 50 may be provided in contact with each other or axially spaced apart to provide a greater axial length (relative to the axis or centerline 51 of the first cavity 46) along which the coil 48 may engage the core 34, and cable 14 generally, to ensure the coil 48 and core 34 are in contact. Further, the first coil 48 may be generally cylindrical with each loop 50 having about the same diameter or enclosing a cross-sectional area of similar magnitude (where similar means within 15%). And the first coil 48 may be open at each end, including an inlet or receiving end in which the cable 14 is initial received and an opposite end, if desired. In at least some implementations, the wire has a diameter between 0.5 mm and 2.5 mm and the first cavity 46 is defined by two or more loops 50 of the wire, and may include ten or more loops. The wire may have any desired cross-sectional shape including but not limited to circular, oval, rectangular.

The second connecting portion 42 may be formed in the same manner as the cable connecting portion 40, and, in at least some implementations, is formed from the same wire as the cable connecting portion 40 such that all features of the coupler 10 are formed in a single, continuous piece of wire. The second connecting portion 42 includes a second cavity 52 in which an end of the terminal 18 is received, and the second connecting portion 42 is hereafter called a terminal connecting portion 42. To securely electrically couple the coupler 10 to the terminal 18, the second cavity 52 may be sized for an interference fit with the terminal 18, so that the terminal 18 is firmly engaged by the coupler 10. In addition to or instead, the core 34 could be soldered to the terminal 18 or another conductive member could be provided to electrically connect the coupler 10 and terminal 18.

The terminal connecting portion 42 may be flexible to facilitate pressing the terminal 18 into the cavity.

In at least some implementations, the terminal connecting portion 42 is formed by a second coil 54 of wire formed from one or more loops 56 wound into a helical and cylindrical formation of a desired size. The individual wraps or loops 56 of the wire in the terminal connecting portion 42 may move relative to other loops 56 which makes the spark plug connecting portion 42 somewhat flexible, and which also provides a plurality of contact points between the coupler 10 and the terminal 18. If desired, the terminal connecting portion 42 may include loops 56 that are in contact with each other, for example with axially facing surfaces of adjacent loops engaged with each other. In other words, this portion 42 may be somewhat tightly wound providing a more solid coil rather than a more spring-like coil in which the individual loops are spaced apart. Further, the second coil 54 may be generally cylindrical with each loop having about the same diameter or enclosing a cross-sectional area of similar magnitude (where similar means within 15%). And the second coil 54 may be open at each end, including an inlet or receiving end in which the terminal 18 is initial received and an opposite end, if desired. Of course, other arrangements may be used, as desired.

In at least some implementations, the size of the first cavity 46 in an at rest state of the coupler 10 is less than the size of the cable 14, providing an interference fit between them when the cable 14 is installed, as noted above. In other words, a cross-sectional area within the first coil 48 may be less than the cross-sectional area of the cable 14 in the area wherein the core 34 is wrapped against the cable exterior surface 36. Rather than press-fitting the cable 14 into the cavity, the first coil 48 that defines the first cavity 46 may be unwound slightly, within the elastic limits of the wire, to increase the size of the cavity interior. The cable 14 may then be relatively easily inserted into the first cavity 46, with the core 34 wrapped or folded against the exterior surface 36 of the cable 14, and then the first coil 48 can be released so that the wire in the area of the first coil 48 elastically returns to its at rest or wound state, the size of the first cavity 46 decreases and the cable connecting portion 40 firmly engages the cable 14 and exposed section of the core 34.

To facilitate unwinding the first coil 48, an end 58 of the wire may be provided at an inlet end 60 of the first coil 48, into which the cable 14 is initially inserted in assembly, and the end 58 of the wire may be defined in a tang 62 that extends outwardly relative to the first coil 48. The tang 62 provides a portion of the wire that may be more easily manipulated in a direction unwinding the first coil 48.

Figure 4:
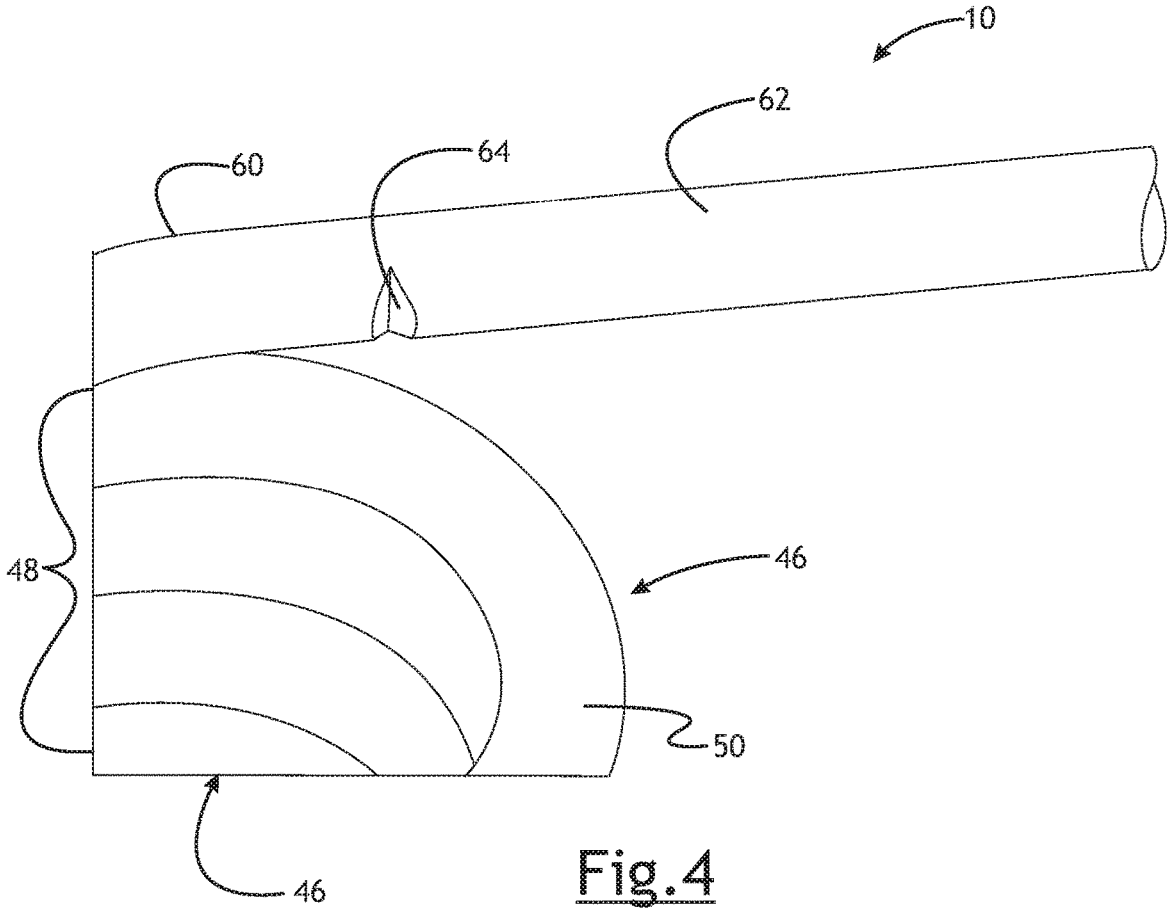
FIG. 4 is an enlarged perspective view of a portion of the coupler showing a weakened portion.
Figure 5:
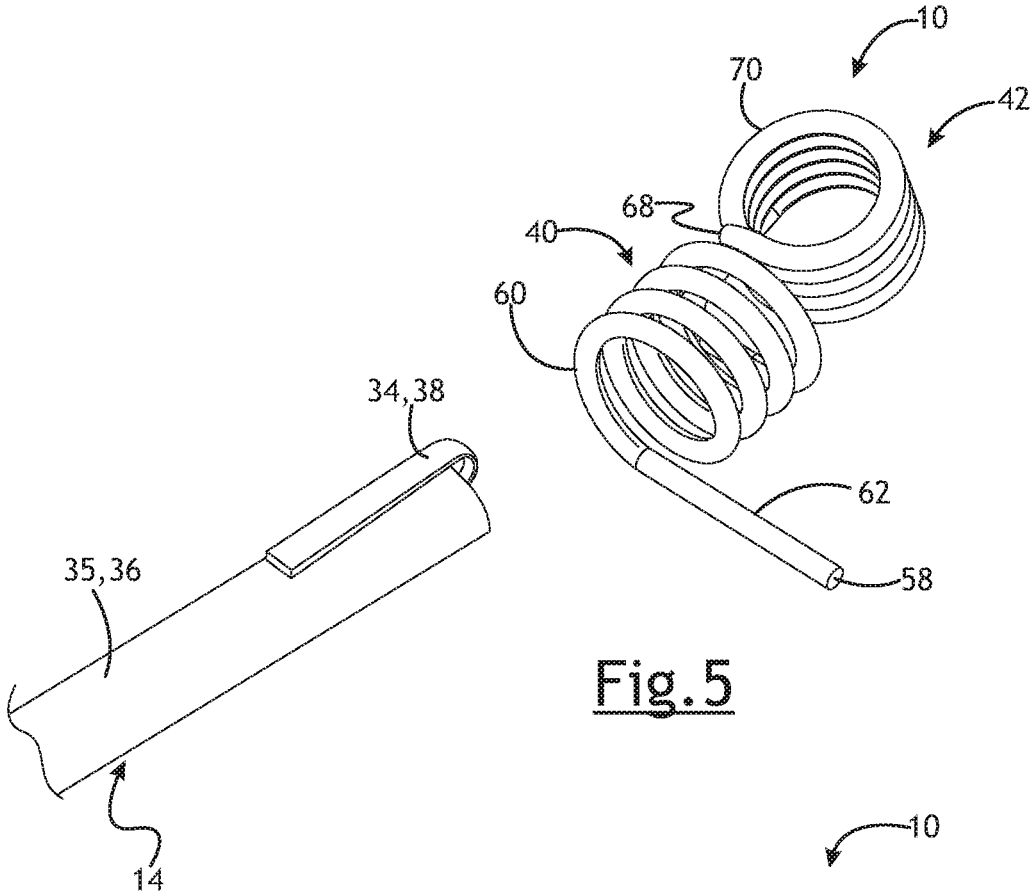
FIG. 5 is a perspective exploded view of the power cable and coupler.
Figure 6:
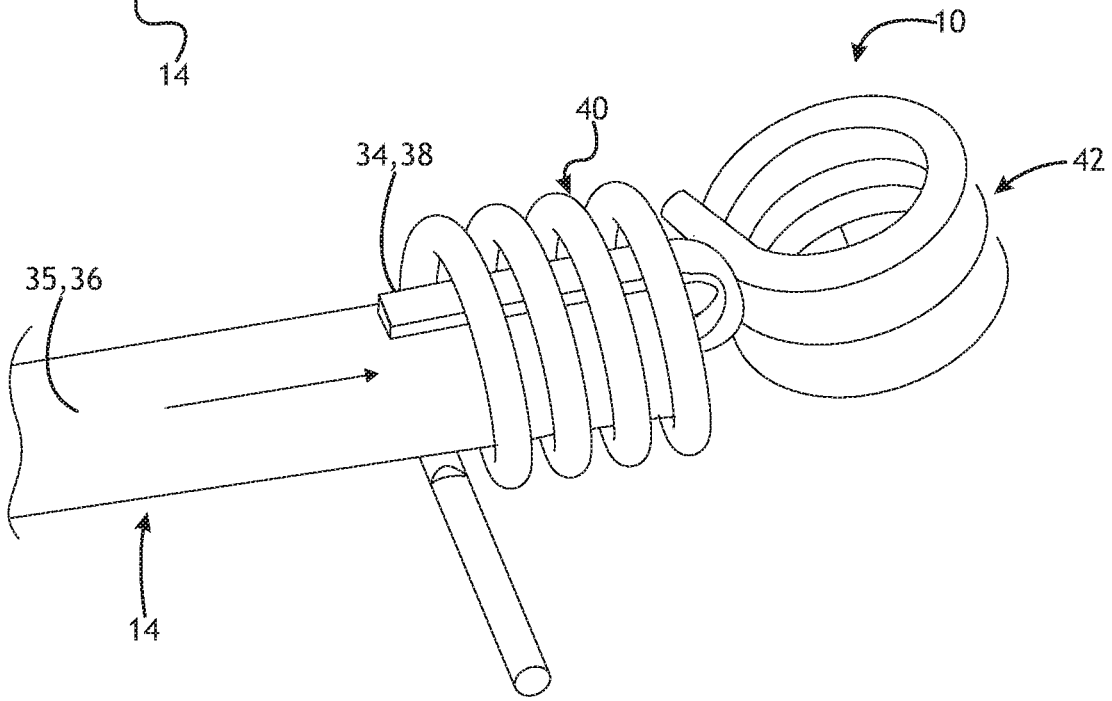
FIG. 6 is a perspective view of the power cable and coupler in an initial assembled state.
Figure 7:
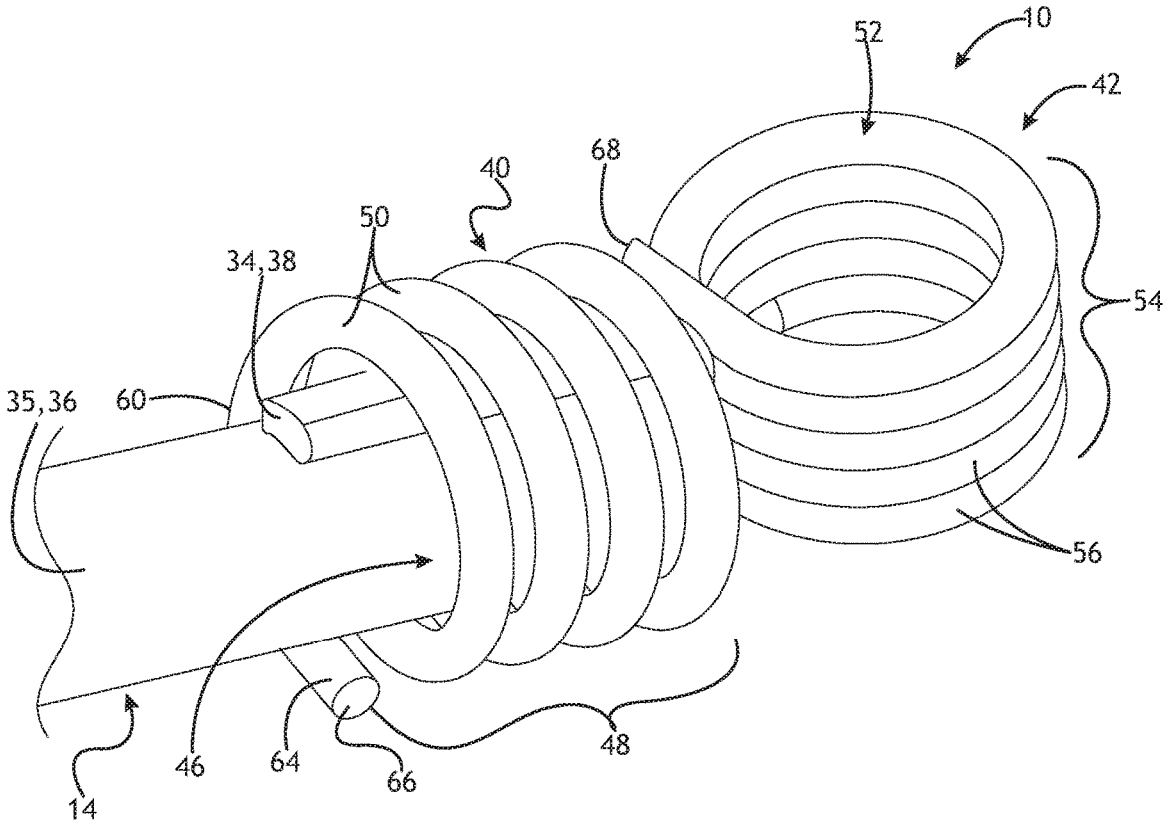
FIG. 7 is a perspective view of the power cable and coupler in a final assembled state of these two components.

In at least some implementations, the tang 62 may include or be defined in a frangible portion of the wire such that the tang may be broken off after the cable 14 is installed into the first cavity 46. The frangible portion may be defined by or include a notch, slot or other weakened portion 64 (shown in at least FIGS. 2 and 4) of the wire. The weakened portion 64 may be provided in an inwardly facing surface of the wire (facing toward the axis 51) or otherwise arranged such that manipulation of the tang 62 beyond a threshold amount in the direction unwinding the first coil 48 will cause the weakened portion to break and thereby separate the tang 62 from the coupler 10. Hence, after the cable 14 is inserted into the first cavity 46, the tang 62 can be further manipulated to break the weakened portion 64 and remove the tang 62 from the coupler 10. The break may occur within or adjacent to the first coil 48 so that the new end 66 of the wire (formed at the location of the break, and shown in FIG. 7) does not extend radially outwardly from the first coil 48, or extends outwardly by 1 mm or less. The end 66 may be crimped or otherwise bent inwardly so that the end does not extend radially outwardly from the coil 48 to reduce the chance that the end 66 will snag or tear the boot 16 during installation of the boot 16.

The other end 68 of the wire may be provided at one end of the second coil 54, and in the example shown, is at an inlet side 70 of the second coil 54. In the example shown, the first end 66 of the wire is at the inlet side 60 of the first coil 48 and the second end 68 of the wire is at the inlet side 70 of the second coil 54. Of course, the wire may be wound in different ways, as desired. With the ends 66, 68 of the wire not protruding outwardly from the coils (or not by more than about 1 mm), the ends of the wire are not snagged by the boot 16 and the boot 16 and coupler 10 are thereby less likely to be damaged during installation into the boot 16.

Figure 8:
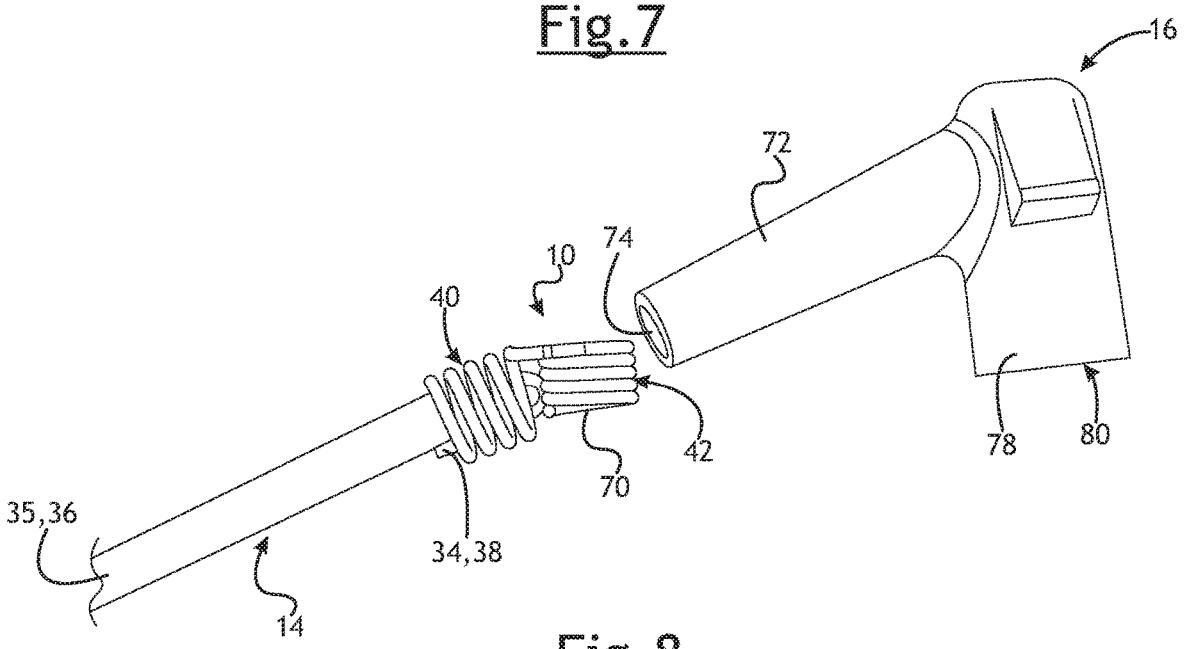
FIG. 8 is an exploded perspective view of the assembly of FIG. 7 and the boot showing a direction of insertion of the assembly into the boot.

As shown in FIGS. 1 and 8, after the cable 14 is connected to the coupler 10 and the tang 62 is removed from the coupler 10, the cable 14 with the attached coupler 10 may be inserted into the boot 16 by pressing the cable 14 and coupler 10 into a first sleeve 72 of the boot 16 which defines a first opening 74 and a first passage 76 of the boot 16. As shown in FIG. 1, the boot 16 includes two sleeves 72, 78 that define or include spaced apart openings and associated passages. The first sleeve 72 is arranged to receive the end of the cable 14. The second sleeve 78 includes a second opening 80 and second passage 82, and is arranged to receive the terminal end of the spark plug 12. The two passages 76, 82 intersect or are communicated with a branch passage or common area, and the coupler 10 spans between the passages 76, 82, for example, the intermediate portion 44 that extends between the cable connecting and terminal connecting coils may extend across or through the intersection between the passages.

So arranged, after the cable 14 and coupler 10 are fully installed into the boot 16, the second coil 54 is arranged within and generally aligned with the second passage 82. Then, the terminal end of the spark plug 12 may be inserted into the second opening 80 and second passage 82, and then may be pressed into the second coil 54, preferably with multiple wire loops 56 engaged with the terminal 18 to ensure a desired electrical connection between the terminal 18 and coupler 10.

While the cable connecting portion 40 and terminal connecting portion 42 may be parallel, and may even be coaxially aligned, in at least some implementations the cable connection portion 40 is oriented at a non-zero angle relative to the terminal connecting portion 42. In other words, the centerline or axis 51 of the cable connecting portion 40 is at a non-zero angle relative to a centerline or axis 86 of the terminal connecting portion 42. In at least some implementations, the angle between the portions is between 15 and 100 degrees, and the sleeves 72, 78 and passages 76, 82 of the boot 16 may be similarly arranged with respect to each other. That is, the coils 48, 54 may be parallel and generally coaxially arranged with their respective sleeves 72, 78 and passages 76, 82. The intermediate portion 44 may be flexible to permit a coupler 10 to be bent or otherwise manipulated to provide a desired angle between the coils. Further, the boot 16 may fully cover the coupler 10, the exposed portion of the core 34 and the spark plug terminal 18 to electrically insulate these components from adjacent components.

The flexible resilient nature of the wire provides flexible and resilient cable and terminal connecting coils 48, 54 that maintain a firm physical and electrical connection with the cable 14 and terminal 18 under various operating conditions including high temperatures and significant vibrations. Further, the flexible intermediate portion 44 may permit the coils 48, 54 to move relative to each other providing an overall flexible and resilient coupler 10, and flexible and resilient coils that maintain a sturdy connection with the cable 14 and terminal 18 in use.

Prior spark plug terminal caps have been formed from sheet metal bent to form a solid clip with two or more solid tabs and a cavity between the tabs. The tabs are deformed by being crimped to the terminal after the terminal is positioned within the clip. However, the solid, more rigid tabs can become loosened in use due to temperature changes and vibrations, thereby degrading the physical and electrical connection between the cap and spark plug 12.

At the cable side, some prior devices utilized a thin, straight prong or needle that was pierced into an end of the cable to connect the prong to the cable core 34. However, the prong may become bent, may damage the cable, may extend outwardly from the cable insulator 35 and damage the boot 16 when installed into the boot, may not properly engage the core within the interior of the cable providing lower than desired or no output (which situation is not detectable from the exterior of the cable), and it may be difficult and time consuming to accurately locate the prong within the cable. Further, with some cables utilizing graphite or other less robust and breakable cores, piercing the cable with the prong may damage or fracture the core. This forces the current to jump the gap at the break and creates electrical noise, which defeats the purpose of using a graphite core (which is to reduce EMC emissions or RFI).

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A coupler for a spark plug, comprising:

a body formed from an electrically conductive material and including a first connecting portion defining a first cavity, and the body includes a second connecting portion defining a second cavity spaced from the first cavity, and the body including an intermediate portion physically and electrically coupling the first connection portion and the second connecting portion, wherein the first connecting portion is formed from a wire coiled to define the first cavity within the coil, and wherein an end of the wire is adjacent to or defines part of the coil that defines the first cavity and the end of the wire is defined in a tang that extends outwardly relative to the coil that defines the first cavity.

2. The coupler of claim 1 wherein the second connecting portion is formed from a wire coiled to define the second cavity within the coil.

3. The coupler of claim 1 wherein the second connecting portion is formed from a wire coiled to define the second cavity within the coil, and wherein the same wire defines both the first and second connecting portions.

4. The coupler of claim 3 wherein the intermediate portion is also defined by the wire that defines both the first and second connecting portions.

5. The coupler of claim 1 wherein the tang extends radially outwardly beyond the coil that defines the first cavity.

6. The coupler of claim 1 wherein the tang is defined in a frangible portion of the wire that is defined by or includes a weakened portion of the wire.

7. The coupler of claim 6 wherein the weakened portion is defined by or includes a notch or slot.

8. The coupler of claim 6 wherein the weakened portion is provided in a surface of the wire that faces inwardly toward a centerline of the coil that defines the first cavity.

9. The coupler of claim 6 wherein the weakened portion of the wire is located in a portion of the wire that is not radially outward of the coil that defines the first cavity or that extends radially outwardly of the coil that defines the first cavity by 1 mm or less.

10. The coupler of claim 1 wherein a second end of the wire is adjacent to or defines part of the coil that defines the second cavity.

11. The coupler of claim 10 wherein the second end of the wire is not located radially outwardly of the coil that defines the second cavity or the second end of the wire is located radially outwardly of the coil that defines the second cavity by 1 mm or less.

12. An assembly, comprising:

a coupler formed from an electrically conductive material and including a first connecting portion defining a first cavity, and a second connecting portion defining a second cavity spaced from the first cavity, and an intermediate portion physically and electrically coupling the first connection portion and the second connecting portion;

a power supply cable having an electrically conductive core and an insulator surrounding the core, wherein a portion of the cable, including part of the insulator and part of the core, is received within the first cavity with a portion of the core engaged with the first connecting portion and received between an exterior of the insulator and the first connecting portion; and a spark plug having a terminal wherein the terminal is received at least partially within and engaged by the second connecting portion.

13. The assembly of claim 12 wherein the first connecting portion is formed from a wire having a first coil that defines the first cavity, and the second connecting portion is formed from a second coil of wire that defines the second cavity, and wherein the same wire defines both the first and second coils.

14. The assembly of claim 13 wherein one or both of the first coil and second coil are defined by loops of wire that may move relative to each other so that the coupler is flexible.

15. The assembly of claim 12 wherein the intermediate portion is also defined by the wire that defines both the first and second connecting portions.

16. An assembly, comprising:

a coupler formed from an electrically conductive material and including a first connecting portion defining a first cavity, and a second connecting portion defining a second cavity spaced from the first cavity, and an intermediate portion physically and electrically coupling the first connection portion and the second connecting portion;

a power supply cable having an electrically conductive core wherein the cable is partially-received within the first cavity with the core engaged with the first connecting portion; and a spark plug having a terminal wherein the terminal is received at least partially within and engaged by the second connecting portion, wherein the first connecting portion is formed from a wire having a first coil that defines the first cavity, and the second connecting portion is formed from a second coil of wire that defines the second cavity, and wherein the same wire defines both the first and second coils, wherein an end of the wire is adjacent to or defines part of the coil that defines the first cavity and the end of the wire is defined in a tang that extends outwardly relative to the coil that defines the first cavity.

17. The assembly of claim 16 wherein the tang extends radially outwardly beyond the coil that defines the first cavity.

18. The assembly of claim 16 wherein the tang is defined in a frangible portion of the wire that is defined by or includes a weakened portion of the wire, and wherein the weakened portion is defined by or includes a notch or slot.

19. The assembly of claim 18 wherein the weakened portion is provided in a surface of the wire that faces inwardly toward a centerline of the coil that defines the first cavity.

20. The assembly of claim 18 wherein the weakened portion of the wire is located in a portion of the wire that is not radially outward of the coil that defines the first cavity or that extends radially outwardly of the coil that defines the first cavity by 1 mm or less.

21. The assembly of claim 16 wherein a second end of the wire is adjacent to or defines part of the coil that defines the second cavity and the second end of the wire is not located radially outwardly of the coil that defines the second cavity or the second end of the wire is located radially outwardly of the coil that defines the second cavity by 1 mm or less.

* * * * *